United States Patent [19]

Haskins

[11] 3,995,749

[45] Dec. 7, 1976

[54] BEER KEG PALLET

[75] Inventor: Lewis Byron Haskins, Littleton, Colo.

[73] Assignee: Johns-Manville Corporation, Denver, Colo.

[22] Filed: Feb. 24, 1975

[21] Appl. No.: 551,932

[52] U.S. Cl. ..... 214/10.5 R; 220/23.4; 108/55.1

[51] Int. Cl.[2] ..... B65D 57/00

[58] Field of Search ..... 214/10.5 R; 108/51 R, 108/55 R, 55 A; 206/821, 504; 220/23.4, 23.6

[56] References Cited

UNITED STATES PATENTS

| | | | |
|---|---|---|---|
| 2,444,326 | 6/1948 | Baker | 108/55 A |
| 3,105,599 | 10/1963 | Hausermann | 214/10.5 R |
| 3,351,264 | 11/1967 | Bostrom | 214/10.5 R |
| 3,628,468 | 12/1971 | Angelbeck | 108/55 A |
| 3,636,888 | 1/1972 | Angelbeck | 108/55 A |

*Primary Examiner*—Robert R. Song
*Assistant Examiner*—John A. Carroll
*Attorney, Agent, or Firm*—Robert M. Krone; Joseph J. Kelly; James W. McClain

[57] ABSTRACT

A pallet for handling cylindrical objects, particularly beer kegs, is disclosed. The pallet has a flat deck with supporting end portions. The inner surfaces of the end portions contain dual curvature segments to rest with and restrain the objects. Intermediate legs are also present for support and further restraint of the objects. Preferably the pallet is molded of a lightweight plastic.

12 Claims, 7 Drawing Figures

BEER KEG PALLET

BACKGROUND OF THE INVENTION

This invention relates to the field of pallets, skids and other materials handling devices. More particularly relates to a pallet particularly adapted to the transport and handling of beer kegs.

Draft beer is marketed by brewers and distributors in generally cylindrical kegs of different sizes containing different quantities of beer. Among the most common keg sizes are those designated the "quarter keg" and the "half keg". In the past these have been handled or transported on conventional pallets with the quarter kegs arranged in an X-shaped pattern of five kegs per pallet and the half kegs arranged in a square pattern of four kegs per pallet. Since these pallets have conventional flat decks, the kegs tend to shift position during repeated handling at the brewery and at the distributor's warehouse, and it has therefore been standard practice to station workers at numerous points throughout the brewery and the warehouse to watch the handling of the loaded pallets and to continuously realign the kegs which are shifted. This use of hand labor to push, shove and otherwise manhandle the barrels in an attempt to maintain assemblance of proper positioning is extremely expensive, wasteful of manpower and highly inefficient.

In addition, the conventional pallets presently in use are themselves very inefficient. Being made of wood they are easily damaged and are very heavy. Further, their configuration and tendency to splinter make it very difficult to handle them efficiently on conventional roller conveyor systems. Again much hand labor is needed to keep these pallets from jamming the conveyor systems as they are moved through the brewery or warehouse.

OBJECTS OF THE INVENTION

It is an object of this invention to provide a pallet particularly adapted for the handling and transport of beer kegs and which by its configuration will substantially eliminate shifting of the kegs and will retain them in place during transport and handling.

It is also an object of this invention to provide a lightweight pallet which can be readily and easily handled and which is resistant to breakage and other damage.

It is also an object of this invention to provide a pallet which can be readily conveyed by roller conveyor systems and which will have little tendency to jam such systems.

BRIEF SUMMARY OF THE INVENTION

The invention herein is a pallet adapted to hold and restrain two different sizes of generally cylindrical objects, particularly beer kegs. The pallet has a flat deck with end portions located at two transversely opposite sides. Each end portion has an upwardly projecting upper portion and a downwardly projecting lower portion. The inner surface of the upper portion contains two pairs of curved surfaces. One curve of each pair has a curvature equivating to respectively one of the sizes of the cylindrical objects, such that when the objects are loaded on the pallet their abutment with each other and their cooperation with the curved surfaces will restrain them in position on the pallet. The inner surfaces of the lower portion may be similarly configured to nest with the objects when the pallets are loaded and stacked. In addition, there will be a pair of legs located intermediate the transverse edges, the sides of which are also contoured to conform to the curvature of the larger of the two sizes of objects. The inner ends of the legs are spaced apart by the width of one of the smaller kegs.

BRIEF DESCRIPTION OF THE DRAWINGS

FIG. 4*a* illustrates an arrangement with four half kegs as the load while FIG. 4*b* illustrates the configuration with five quarter kegs as the load.

DETAILED DESCRIPTION AND PREFERRED EMBODIMENTS

Figure 1:
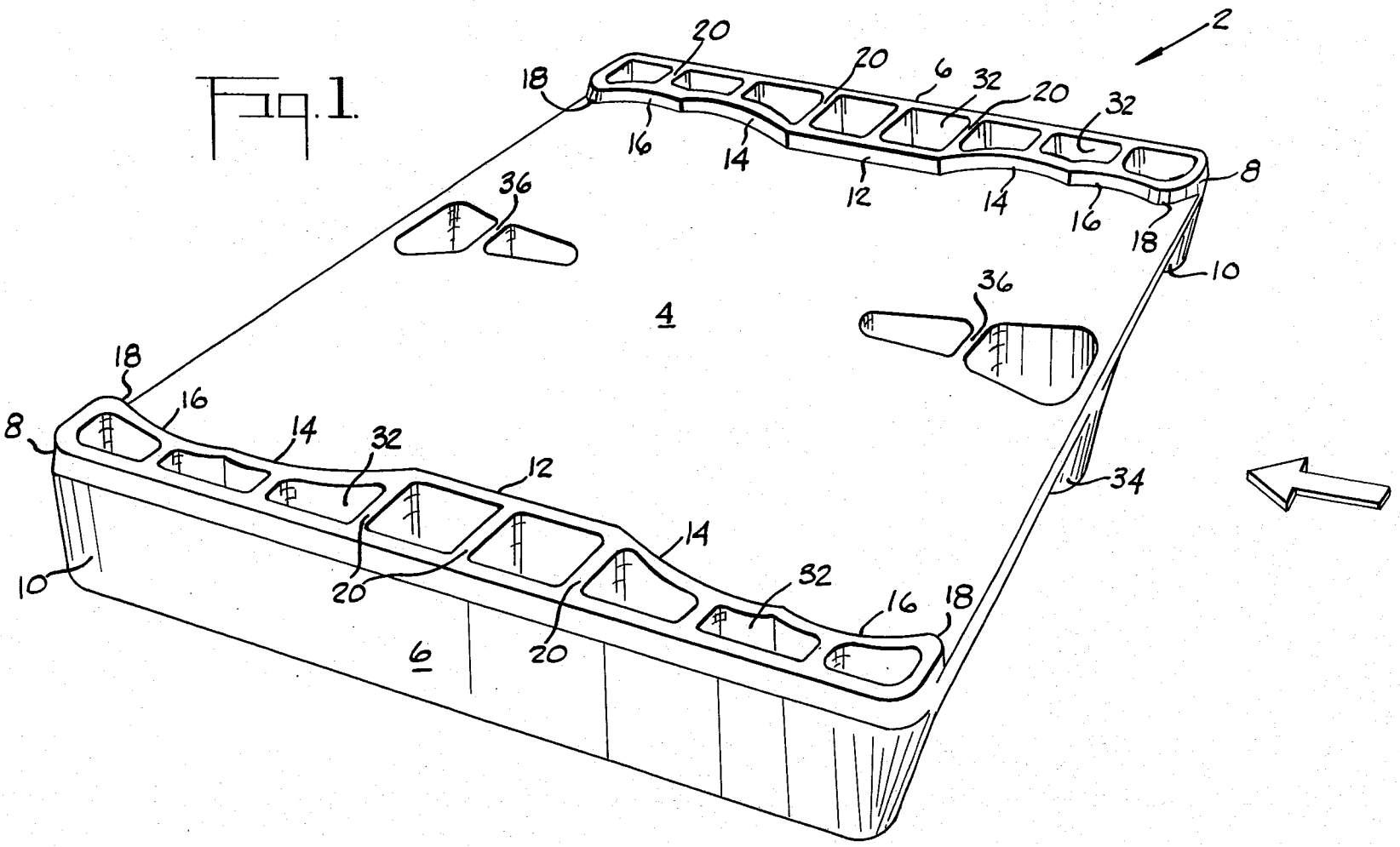
FIG. 1 and FIG. 2 are perspective views of a pallet of the present invention, FIG. 1 being a view of the pallet from above and FIG. 2 being a view of the pallet from below.
Figure 2:
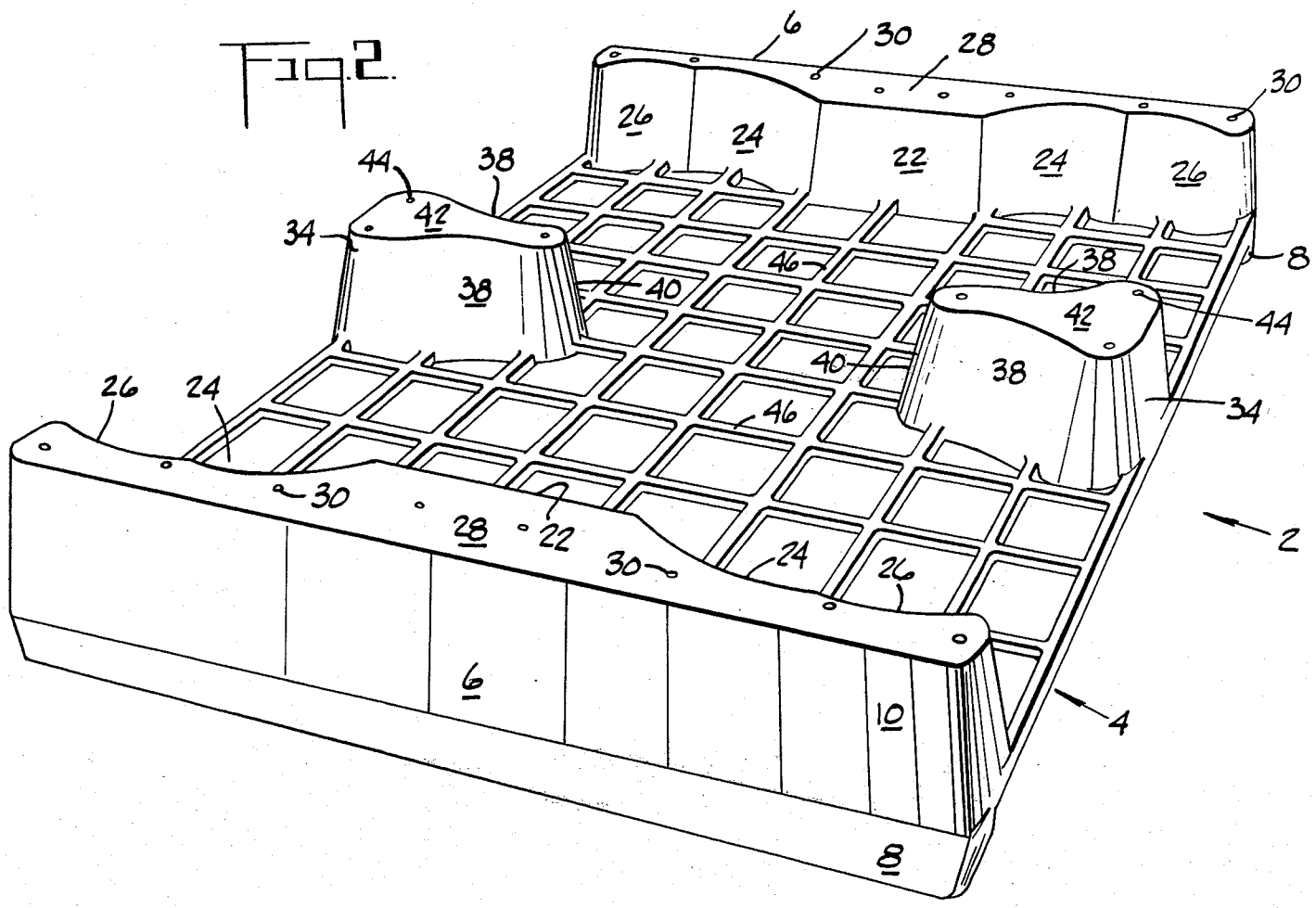

The pallet of the present invention is best illustrated by reference to FIGS. 1 and 2, FIG. 1 showing the pallet in an upright position and FIG. 2 showing the pallet upside down.

The pallet (generally designated 2) contains a flat deck 4 which is bounded on its two transverse sides by edge portions 6. It is the structure of these edge portions which provides the restraining means for the beer keg loads.

Each end portion 6 will be seen to be divided into an upper portion 8 and a lower portion 10 with the deck 4 serving as the separation between the upper and lower portions. Upper portion 8, which is best seen in FIG. 1, consists of a center section 12 which is generally straight and parallel to the longitudinal axis of edge portion 6. The particular shape of center section 12 is not critical and need not be straight, although this is the most economical form. Curves or irregularities which do not interfere with the beer keg placement may be present.

Upper portion 8 also contains two inner sections 14 and two outer sections 16. The shape of each of these sections is critical to the present invention and will be designed specifically for the particular shape of beer keg to be handled. The exact nature of these curves will be defined below. Each of sections 16 also contains an end segment 18 whose function will be explained below. While edge portions 6 may be solid if desired, it is more economical of material and contributes to the light weight of the pallet to have these portions substantially hollow and stiffened by transverse ribs such as 20.

The lower portion 10 of edge sections 6 has a shape similar to that of the upper portion 8, consisting of center section 22 and a pair of inner sections 24 and outer sections 26. The vertical height of lower portion 10 is substantially greater than the vertical height of upper portion 8, so that when the pallet is in its upright position as shown in FIG. 1 the tines of a forklift truck may be readily inserted under the pallet. The bottom of lower portion 10 consists of a flat solid surface 28. This surface (and the bottom surface of legs 34 to be described below) must be flat in order to permit the pallet to travel easily on roller conveyor systems. This surface will commonly be provided with drain holes 30 at the bottom of each of the hollow sections 32 so that any water or other liquid which may impinge upon the pallet will not accumulate in the hollows 32.

Centrally located between the edge sections 6 on the underside of the pallet are legs 34. These are of a vertical height equal to the height of the lower portion 10 of end section 6 so that when the pallet is standing upright the two legs 34 and the two edge sections 6 form a solid support for the deck 4. The legs 34 are themselves hollow and may be stiffened by transverse ribs such as 36. In the configuration shown the legs 34 do not have any portion projecting above the surface of deck 4. Since the beer kegs will be adequately restrained in position without such upward projections of legs 4 the configuration shown in FIG. 1 is preferred. In this configuration it is substantially easier to mold the pallets of materials such as plastic. On the other hand, if the pallets are manufactured in some other manner than by molding such upward projections could be used if desired. Their outer surfaces would have to conform to the keg restraining configurations to be discussed below. Legs 34 are symmetrical and of a concave V-shape with sloping curved sides 38 and inward ends 40. The bottom surfaces 42 of legs 34 are flat and may contain drain holes 44 in like manner as edge portions 6.

The underside of deck 4 may if desired be reinforced by a network of ribs 46. The ribbed structure is preferred, since the use of stiffening ribs allows the deck itself to be rather thin and thus saves substantial weight without significant weakening of the pallet.

The pallet may be made of any suitable lightweight material. It is particularly preferred to make the pallet out of molded plastic such as high density polyethylene. Many other moldable or foamed plastic materials would also be suitable and such materials are well known to those skilled in the art. Plastic also has the distinct advantage of being readily cleanable with steam, a factor of importance in the beer industry. Similarly, the preferred method of manufacture of the pallets is by conventional plastic molding technique using regular or foamed plastics. Other materials such as fiberboard, corregated cardboard, light sheet metal or the like may also be used for the pallet, but these require substantially more tedious and difficult fabrication methods, are not as light in weight as the plastic, in many cases are not cleanable, and therefore are not preferred. In selecting materials for construction it must be remembered that a load of four full half kegs will weigh on the order of 600 lbs. and a load of five full quarter kegs will weigh on the order of 400 lbs.; materials and stiffening structures such as ribs 46 must be selected to accommodate this weight.

Figure 3:
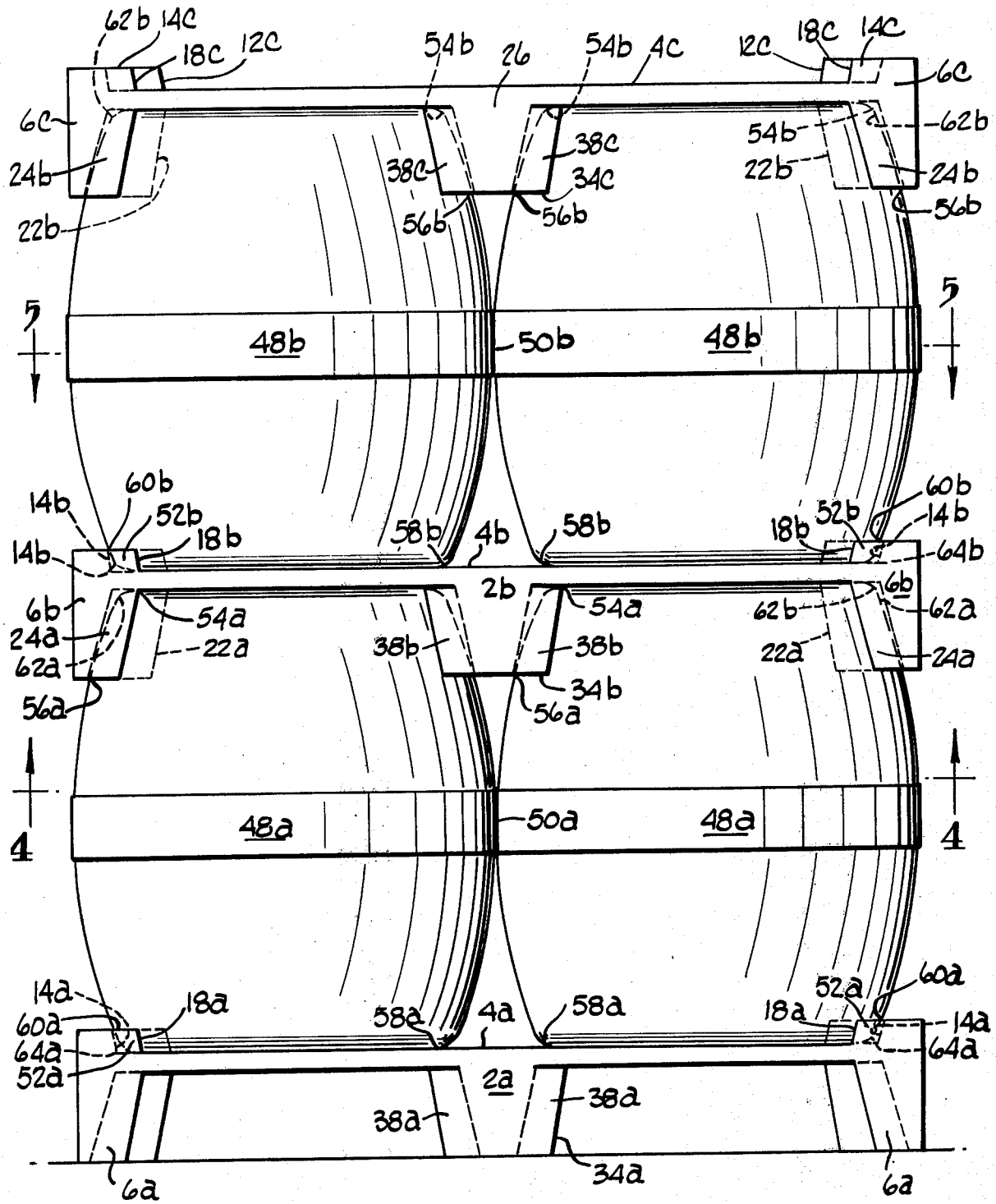
FIG. 3 is a side elevation view taken generally in the direction indicated by the large arrow in FIG. 1, illustrating three typical pallets in a loaded and stacked configuration.
Figure 4A:
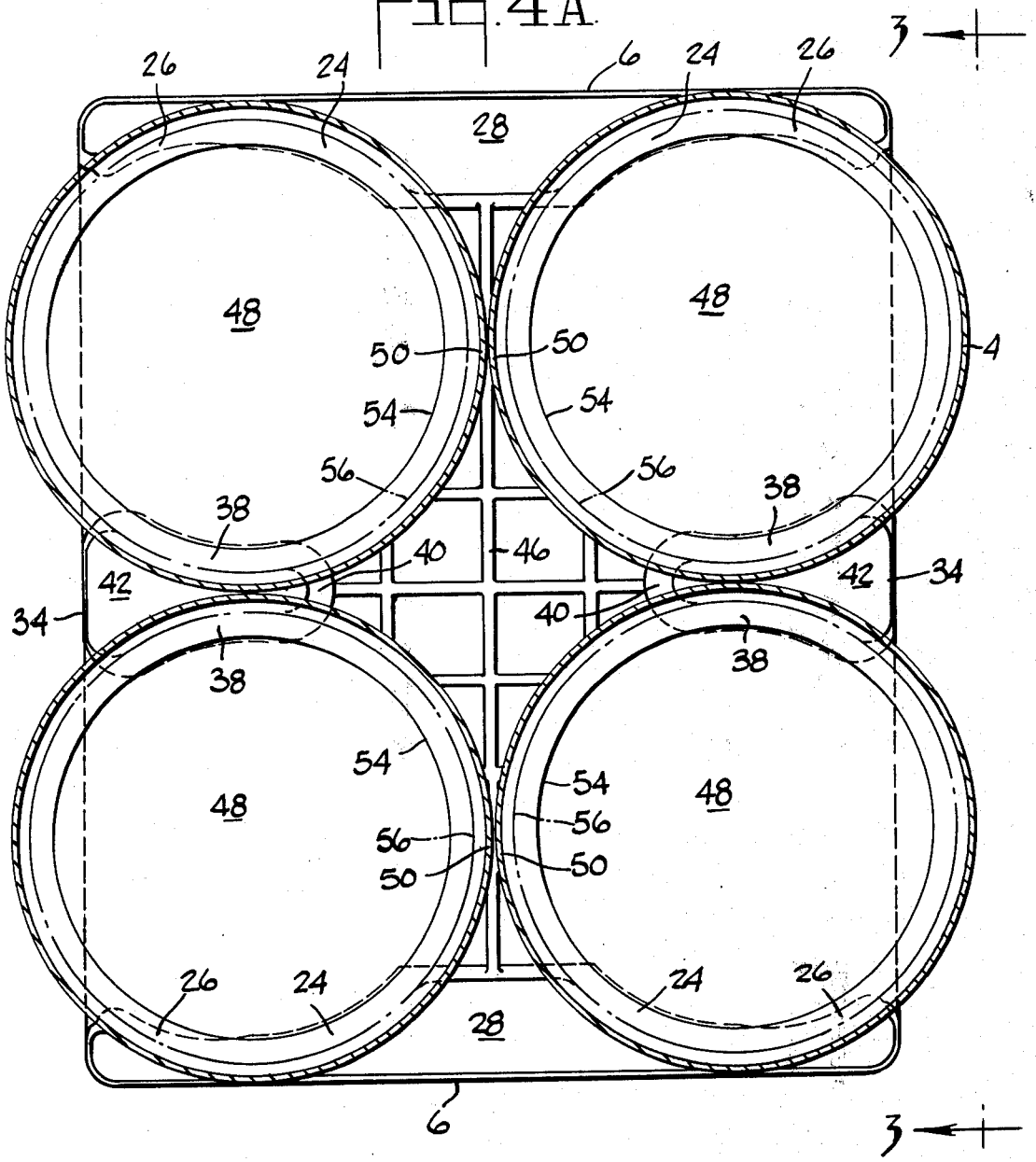
FIGS. 4*a* and 4*b* are cross-sectional views taken generally on plane 4—4 of FIG. 3 and illustrating the manner in which the pallets of this invention restrain the beer kegs.
Figure 4B:
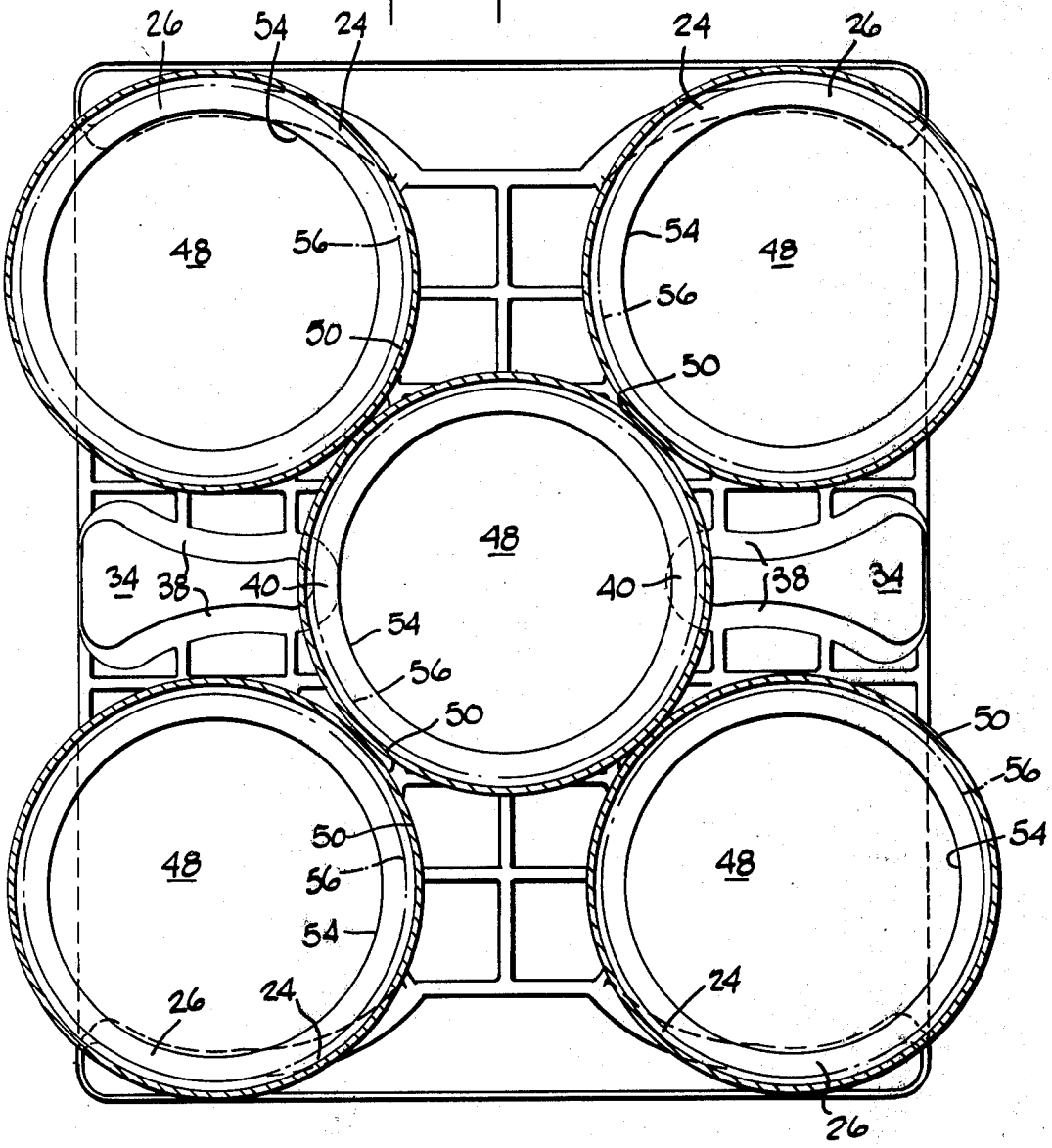
Figure 5A:
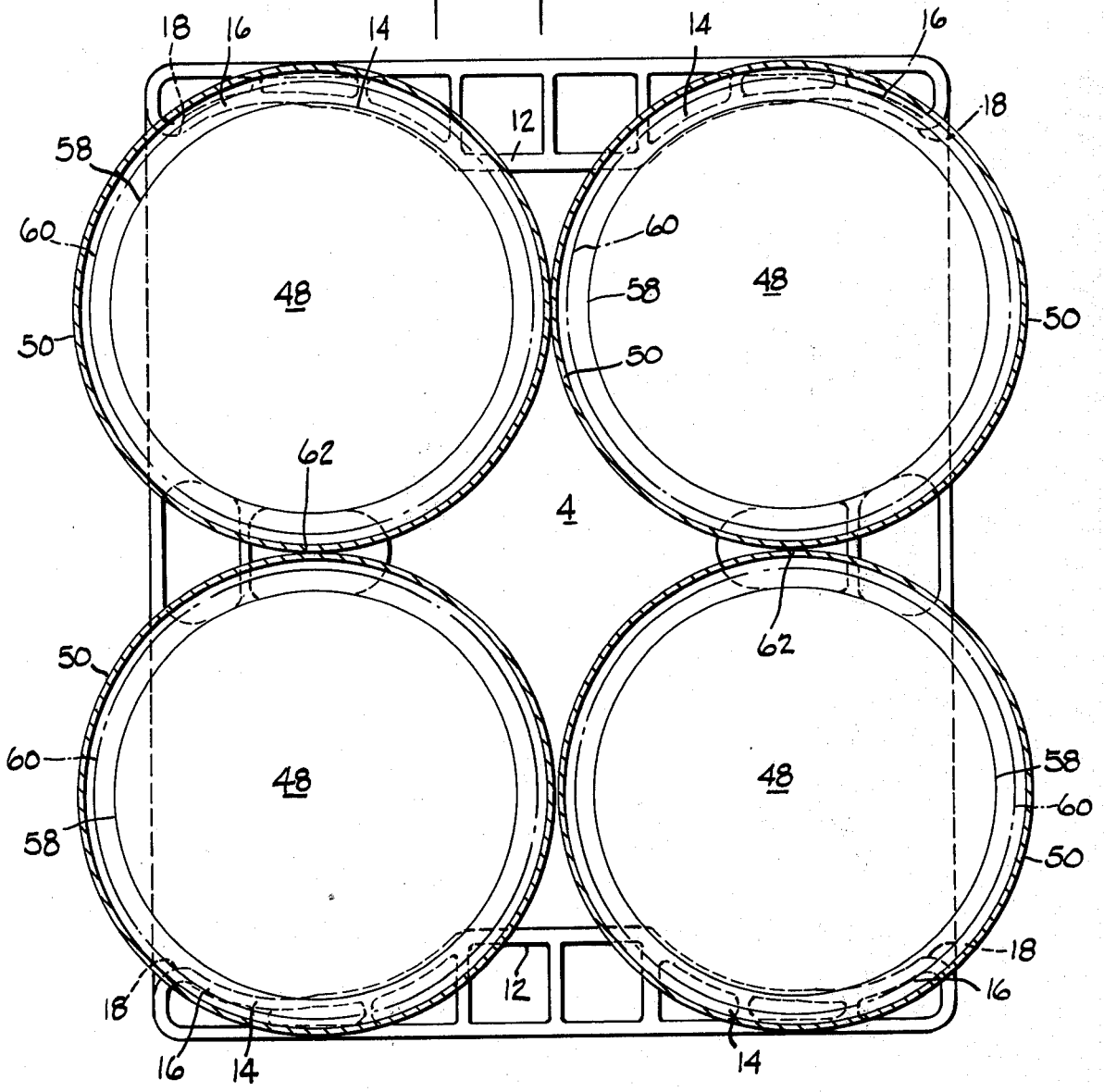
FIGS. 5*a* and 5*b* are similar to FIGS. 4*a* and 4*b* except that they are views taken on line 5—5 of FIG. 3.
Figure 5B:
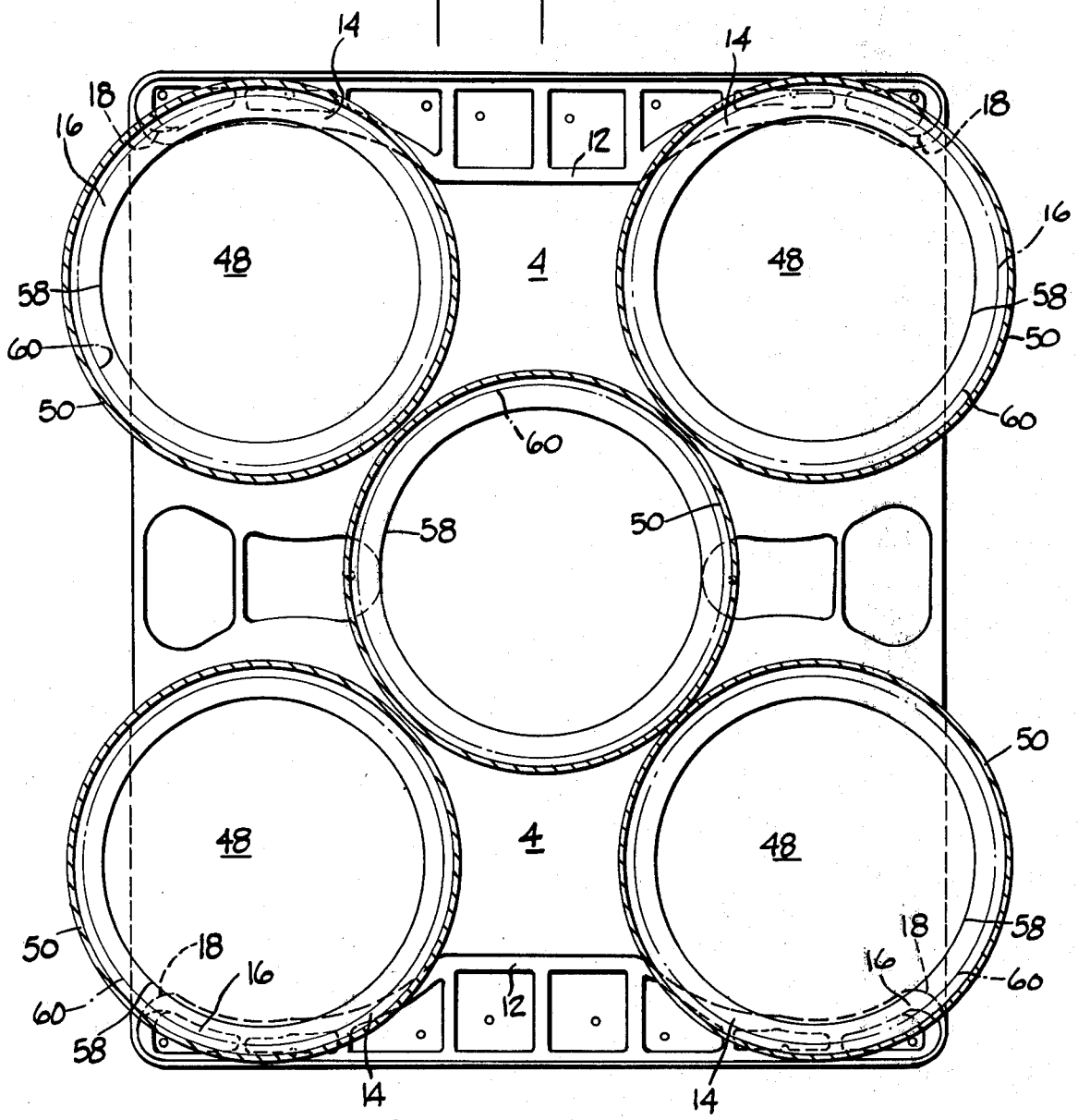

The critical shapes, placement, and curvature of the various legs, surfaces and end portions is dictated by the manner of use of these pallets, which is illustrated in FIGS. 3, *4a* and *4b*, and *5a* and *5b*. Three pallets (designated *2a*, *2b* and *2c*) are shown loaded with half kegs on pallets *2a* and *2b*. The kegs 48 touch at their widest points 50 and are thus restrained from inward movement. The lower outer portion 52 of each keg nests in the curvature of inner portion 14 (or outer portion 16 if quarter kegs are loaded). This prevents lateral motion of the kegs and the end segments 18 prevent the kegs from moving off the open end of the deck. In this manner an individual pallet operates to prevent any substantial shifting of its particular load of kegs.

Lack of shifting of the kegs may be further insured by nesting on top of the kegs a second pallet *2b* which may itself have kegs *48b* (of either half or quarter size) stacked on it. The underside of pallet *2b* nests on the kegs below with half kegs nesting with inner portions 24 and the quarter kegs nesting with outer portions 26 of lower portion 10. In addition, the half kegs nest with surfaces 38 of legs 34 and are thus totally restrained from outward movement. Where quarter kegs are involved the upper surface of the center keg nests with inward ends 40 of legs 34. Cooperation between inward ends 40 as transmitted through the center keg and the four outer kegs to surfaces 26 completely restrains the quarter kegs.

The nesting of the kegs and the restraining influence of the various surfaces are illustrated in FIGS. *4a* and *4b*. FIG. *4a* shows a load of four half kegs. In FIG. *4a* circle 54 represents the diameter of each keg at its top. Circle 50 indicates the diameter of each keg at its widest point. Circle 56 is an imaginary line indicating the diameter of the keg at the point where it meets the lowest edge of surface 24. (A pair of similar circles 58 and 60 correspond to the diameter of the keg at its base and the diameter of the keg at the point where it intersects with the upper edge of surface 14, as illustrated in FIGS. 3 and *5a*).

It will be immediately evident from FIGS. 3 and *4a* that inward surface 24 is sloped and curved to substantially conform to the curvature and slope of the key 48. The radius of curvature of the keg in this upper portion is substantially the same as the corresponding portion of surface 24. The slope may differ slightly, however, with the pallet surface having a relatively straight slope such that while the pallet and keg nest readily together there is a small area of non-contact as indicated by 62 in FIG. 3 (and a corresponding area 64 at the lower end of the keg). Similarly the sides 38 of leg 34 will be of equal radius to the keg and of substantially the same slope.

The corresponding configuration of five quarter kegs is shown in FIG. *4b*. It will be noted here that the kegs nest with outer surfaces 26 and that the four outer kegs do not contact the sides 38 of legs 34. Each of the four outer kegs contacts the central keg at the widest point of each. The central keg in turn is in contact with inner ends 40 of legs 34 whose surfaces are configured to fit the contours of the keg in the same manner as surfaces 26.

The restraint of the kegs by the lower pallet separately is illustrated in FIGS. *5a* and *5b*. Considering first FIG. *5b*, which illustrates a load of five quarter kegs, it will be seen that the kegs nest with outboard surface 16 and are prevented from outboard movement by the curvature of that section and also by the inward termination at point 18. The X-shaped arrangement of the five kegs and the cooperation of surfaces 16 prevent the outward movement of the kegs. Friction of the kegs at their widest surfaces inhibits the outer kegs from sliding past the central keg and the curvature of the surface 16 prevents the kegs from pivoting at their meeting points to swing outward.

The loading of four half kegs is illustrated in FIG. *5a*. Here the kegs 48 nest with surfaces 14 and meet at their inner edges 50. The kegs are thus prevented from lateral movement toward the closed edges of the pallet. In this configuration the large kegs can move slightly to the open end of the pallet by pivoting about their meeting points (designated 62) but only a short distance of outward travel is permitted before the portion of the keg between lines 58 and 60 comes into contact with end segment 18 of outer surface 16, thus restraining the keg from any further outward travel.

It will immediately be evident that the pallets of this invention permit easy handling and transport of beer kegs with virtual elimination of any concern about shifting of the kegs. Substantial quantities of hand labor for realigning kegs is thus eliminated. In addition a substantial safety problem is also eliminated, for if a worker fails to notice a misaligned keg the keg can later fall off of the pallet and cause injury to a passerby and/or destruction of the keg.

What I claim is:

1. A pallet adapted to hold and restrain two different sizes of generally cylindrical objects such as beer kegs, which comprises a. a flat deck having two end portions at the opposite edges thereof;

b. each end portion having an upper and lower portion, said lower portion extending downwardly from said deck and said upper portion extending upwardly from said deck;

c. the inner surface of each of said upper portions having two pairs of curved segments, each pair having a curvature conforming to respectively the curvature of one of the sizes of said cylindrical objects;

whereby when said objects are placed on said deck they are restrained by their abutment with each other and cooperation with said curved segments.

2. The pallet of claim 1 wherein the outmost portion of each inner surface partially serves to restrain the larger of said objects.

3. The pallet of claim 2 wherein said lower portions of said end portions also contain two pairs of curved surfaces conforming in curvature with the curvature of said objects.

4. The pallet of claim 3 wherein said deck has projecting downwardly from the area intermediate said edge portions two legs, said legs being of a height equal to that of said lower portions of said edge portions.

5. The pallet of claim 4 wherein each of said legs has a V-shape with sides conforming in curvature to the curvature of the larger in size of said objects.

6. The pallet of claim 4 wherein said legs are spaced apart a distance equivalent the diameter of one of the smaller in size of said objects, and the innermost surface of each of said legs has a curvature conforming to the curvature of said smaller object.

7. The pallet of claim 1 wherein said deck contains stiffening ribs on its lower surface.

8. The pallet of claim 1 wherein the lower surfaces of said end portions are flat.

9. The pallet of claim 4 wherein the lower surfaces of said end portions and said legs are flat.

10. The pallet of claim 1 wherein said end portions are generally hollow and stiffened with transverse ribs.

11. The pallet of claim 1 being molded from plastic.

12. The pallet of claim 11 wherein said plastic is high density polyethylene.

* * * * *